US006381438B2

(12) United States Patent
Kubo

(10) Patent No.: US 6,381,438 B2
(45) Date of Patent: Apr. 30, 2002

(54) IMAGE FORMING APPARATUS AND IMAGE FORMING METHOD

(75) Inventor: Norihiko Kubo, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/788,433

(22) Filed: Feb. 21, 2001

(30) Foreign Application Priority Data

Feb. 23, 2000 (JP) ..... 2000-046038

(51) Int. Cl.[7] ..... G03G 21/00
(52) U.S. Cl. ..... 399/350; 430/125
(58) Field of Search ..... 399/27, 28, 343, 399/345, 347, 350, 351; 430/107, 109, 111, 125

(56) References Cited

U.S. PATENT DOCUMENTS 5,212,530 A * 5/1993 Harada et al. ..... 399/350
6,183,930 B1 * 2/2001 Ueda et al. ..... 430/125

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

An image forming apparatus has an image bearing member for bearing an electrostatic latent image, a charging device for applying a voltage to the surface of said image bearing member to charge the surface thereof, electrostatic latent image forming means for forming an electrostatic latent image on the surface of said image bearing member charged by said charging device; developing means for adhering the toner carried on a toner carrying member to the electrostatic latent image formed on the surface of the image bearing member to form a toner image, a transfer material carrying member for carrying and conveying a transfer material to the surface of said image bearing member, transferring means for electrostatically transferring the toner image formed on the surface of said image bearing member to a transfer material, and cleaning means for cleaning said image bearing member.

38 Claims, 3 Drawing Sheets

IMAGE FORMING APPARATUS AND IMAGE FORMING METHOD

BACKGROUND OF THE INVENTION

1. Field of the Invention

The present invention relates to an image forming apparatus and image forming method using the electrophotographic method and more specifically, to an image forming apparatus and image forming method with an improvement in a cleaning step for cleaning the spherical toner remaining on an image bearing member after a transfer step.

2. Related Background Art

In these days, a complex machine serving jointly for all output terminals such as copier, printer and facsimile has been widely accepted in the market. As such a network-ready terminal, the electrophotographic system is widely used. One of the problems to be solved in this electrophotographic system is to enhance the Duty Cycle of a main body. "Duty Cycle" means the limit of the number of sheets within which the main body continues operating normally without maintenance by a service person. One of the most crucial rate-determining factors in Duty Cycle is the service life of an image bearing member (hereinafter, also referred to as "photosensitive member").

On the other hand, from the viewpoint of ecology, it is required to eliminate the waste, that is, to reduce the expendable, to prolong the service life of expendables and to promote the reliability of the expandables. Transit from a conventional analog machine to a new digital machine has advanced and the cost of a main body is also required to be made equal to or lower than that of an analog machine. Furthermore, in the field of a copier and a printer, a monochrome machine formerly constituted the main-stream, but recently, making a draft or an output file into full color is rapidly increasing in offices. In addition to making the cost of the main body in a digital machine equal to or lower than that of the analog machine as mentioned above, the main body cost and the running cost of a full-color copier or printer has been required to be equal to that of the monochrome machine. For this reason, a technique has been desired which enables TCO (Total Cost of Ownership: total necessary cost viewed from a user) to be dramatically reduced.

Under such circumstances, in recent years, a full-color image forming apparatus for transferring the respective color toner images, different in color, formed on individual photosensitive members to the transfer material carried on a transfer belt in successive overlap to obtain a color image, comprising multiple image bearing members and a transfer belt for carrying and conveying an image transferring material, quadruple tandem type full-color image forming apparatus has become main. In an image forming apparatus repeating the step of transferring a transferable image formed on the surface of an image bearing member to a transfer material chiefly made of paper, it is indispensable to fully remove the residual toner remaining on the image bearing member without transferring to the transfer material after the transfer.

Consequently, numerous proposals have so far been made as cleaning means, but means as scraping off the residual toner by means of a cleaning blade comprising an elastic material such as urethane rubber is widely put to practical use, because of being simple and compact in configuration, inexpensive and further excellent in tone removal function. As rubber material of a cleaning blade, urethane rubber is used in general which is high in hardness, rich in elasticity and outstanding in wear resistance, mechanical strength, oil resistance and ozone proof property.

The image bearing member comprises a photosensitive layer and protecting layer provided on a conductive support, while the outermost layer of this image bearing member contains fluorine-atom-contained resin fine particles and the used one is mechanically polished so as to set the 10 point average surface roughness Rz (hereinafter, referred to as "average surface roughness") defined by JIS standard B061 to a moderate range. So far, it has been considered that the slidability between the outermost layer of the image bearing member and the cleaning blade is lost, the surface of the outermost layer is roughened by wear and micro-grained toner out of the residual toner during the transfer becomes likely to slip off through the surface if a value of this Rz is too small, whereas if a value of Rz is too large, a gap appears between the outermost layer of the image bearing member and the cleaning blade and the residual toner is likely to slip off though this gap.

In a system that plenty of scraped dust of the outermost layer of the image bearing member is generated and aggregated, the blade edge is instabilized and especially when high roundness toner is used, slip-off of toner actually occurs, so that a further improvement is desired for such a system.

Thus, it is desired to effectively prevent the occurrence of toner slip-off in the use of high roundness toner and to suppress the wear of the outermost layer of the image bearing member for the attainment of a long service life of a photosensitive member.

SUMMARY OF THE INVENTION

It is one object of the present invention to provide an image forming apparatus and an image forming method in which the above problems have been solved.

It is another object of the present invention to provide an image forming apparatus and an image forming method capable of accomplishing a good cleaning also for high roundness spherical toner.

It is another object of the present invention to provide an image forming apparatus and an image forming method capable of accomplishing a good cleaning also for high roundness spherical toner even if the wear of a photosensitive member is suppressed and the service life is prolonged.

It is another object of the present invention to provide an image forming apparatus comprising:

- an image bearing member for bearing an electrostatic latent image;
- a charging device for applying a voltage to the surface of the image bearing member to charge the surface thereof;
- electrostatic latent image forming means for forming an electrostatic latent image on the surface of the image bearing member charged by the charging device;
- developing means for adhering the toner carried on a toner carrying member to the electrostatic latent image formed on the surface of the image bearing member to form a toner image;
- a transfer material carrying member for carrying and conveying a transfer material to the surface of the image bearing member;
- transfer means for electrostatically transferring the toner image formed on the surface of the image bearing member to a transfer material; and
- cleaning means for cleaning the image bearing member, wherein the toner comprises toner particles with a shape factor SF-1 of 100 to 140 and a shape factor SF-2 of 100 to 120, the cleaning means comprises a cleaning blade brought into butt contact with the surface of the image bearing member in a counter direction at a line pressure N higher than 20 g/cm and lower than 60 g/cm, and the cohesive degree $\alpha$ of powder ranges from 10% to 60%, the powder including the scraped dust which is generated by wearing of the outermost layer surface of the image bearing member due to butt contact with the cleaning blade and accumulated at the edge of the cleaning blade.

It is another object of the present invention to provide an image forming method comprising:

a charging step of applying a voltage to the surface of the image bearing member to charge the surface thereof;

electrostatic latent image forming step of forming an electrostatic latent image on the surface of the charged image bearing member surface;

a developing step of adhering the toner carried on a toner carrying member to the electrostatic latent image formed on the surface of the image bearing member to form a toner image;

a transferring step of electrostatically transferring the toner image formed on the surface of the image bearing member to a transfer material; and a cleaning step of cleaning the surface of the image bearing member after the transferring step by means of cleaning means;

wherein the toner comprises toner particles with a shape factor SF-1 of 100 to 140 and a shape factor SF-2 of 100 to 120, the cleaning means comprises a cleaning blade brought into butt contact with the surface of the image bearing member in a counter direction at a line pressure N higher than 20 g/cm and lower than 60 b/cm, and the cohesive degree $\alpha$ of powder ranges from 10% to 60%, the powder including the scraped dust which is generated by wearing of the outermost layer surface of the image bearing member due to butt contact with the cleaning blade and accumulated at the edge of the cleaning blade.

DESCRIPTION OF THE PREFERRED EMBODIMENTS

Rather than directly caused by the roughness due to wear of the outermost layer of an image bearing member, examinations of the inventors has revealed that occurrence of toner slip-off through a cleaning blade is because scraped dust of the outermost layer of an image bearing member brought about by the wear are accumulated and aggregates at the cleaning blade edge and as a result the blade edge is instabilized, thus inducing micro-gain-sized toner to slip off through the blade edge. To be more specific, a stable butt contact of a blade edge permits an auxiliary such as lubricant or abrasive to form a layer in front of the blade edge, which serves for a shield as hindering toner from reaching the blade edge, thereby securing a good cleaning, whereas in a system that plenty of scraped dust are generated from the outermost layer of the image bearing member and aggregates, it was found that the blade edge was instabilized and a condition that the layer of an auxiliary could not be present stably was created, thus inducing high roundness toner to slip off.

Figure 3:
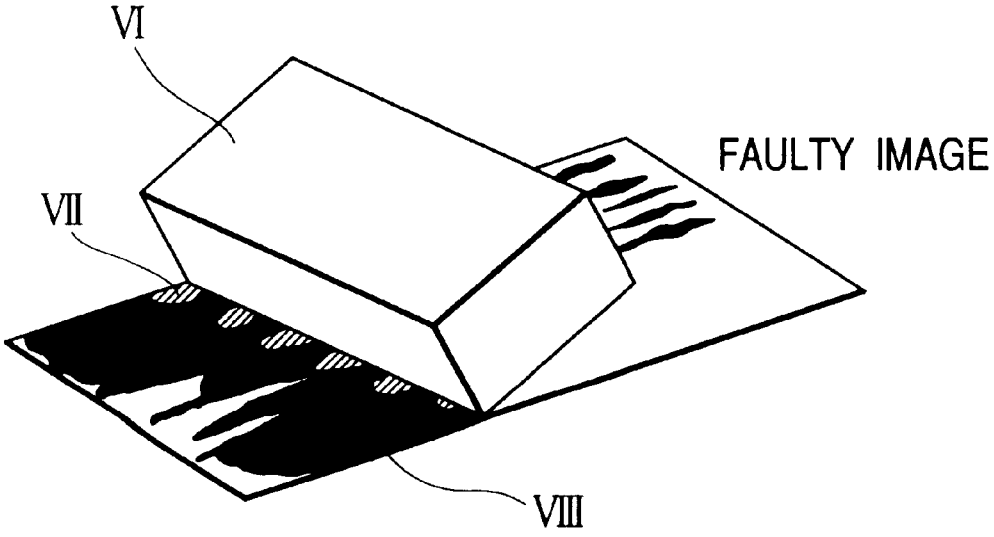
FIG. 3 is an image representation of aggregation of scraped dust of the outermost layer of an image bearing member in an image forming apparatus according to the present invention.

An image representation in the case where the aggregation of scraped dust of the above photosensitive member at the blade edge part instabilizes the blade edge and induces high roundness toner to slip off was cited in FIG. 3.

In order to improve the slidability between an image bearing member and a cleaning blade and prevent an abnormal vibration and burrs, an attempt has been made to have fluorine resin fine particles contained in the outermost layer of an image bearing member, but too much content of fluorine resin fine particles in the outermost layer of an image bearing member allows a latent image to be formed only shallowly, so that at a short pause of AC voltage, the AC voltage is stopped for low tribo toner and a latent image cannot be transferred for a period till the application of a pull-back voltage. Thus, the unevenness in the tribo of toner tends to be directly reflected to that of dots, thereby resulting in formation of an uneven image. However, it has been also found that an exceedingly reduced content of fluorine resin fine particles worsens the slidability between an image bearing member and a cleaning blade and amplifies the amount of scraped dust due to the wear of the outermost layer of an image bearing member and the aggregation of scraped dust makes it easy for toner slip-off to occur.

Since the slip-off of high roundness toner can be suppressed so as to permit a good cleaning by controlling the cohesive degree $\alpha$ of high roundness powder containing the scraped dust, which is generated by wearing of the outermost layer surface of the image bearing member due to butt contact with the cleaning blade and accumulated at the edge of the cleaning blade, in the counter blade cleaning to be within a specific range, the butting pressure of the cleaning blade on the image bearing member can be set to a low value and accordingly the wearing of the image bearing member is reduced, thereby enabling a longer service life to be attained. Based on this fact, the inventors found that an epoch-making decrease in TOC became performable and therefore arrived at the present invention.

The present invention will be described below in detail.

<1> Toner in the present invention

The toner used in an image forming apparatus according to the present invention comprises nearly spherical toner particles with a shape factor SF-1 of 100 to 140 and ones with a shape factor SF-2 of 100 to 120 and toner comprising nearly spherical toner particles with such a shape factor is preferably used because of capable of maintaining a high transferring efficiency.

In the present invention, the shape factor of toner particles preferably comprises SF-1 lying within a range of 100 to 130 and SF-2 lying within a rage of 100 to 115.

Shape factor SF-1 referred here means a value indicating the ratio of roundness in the shape of a particle and represented by the value obtained by dividing the projection area (AREA) into a square of the maximum length (MXLNG) of the projected image formed by projection of a particle onto a 2-dimensional plane and then multiplying the quotient and $100\pi/4$ together. Namely, a shape factor SF-1 is defined by Equation (1):

[Equation 1]

$$SF\text{-}1=\{(MXLNG)^2/\text{AREA}\}\times(100\pi/4) \quad \text{(I)}$$

The greater a value of SF-1 is, the more likely the shape of a particle becomes to be indefinite.

If a value of SF-1 is too great in this invention, toner cannot fully lubricants a cleaning blade and consequently there may happen a problem such as chattering or blurrs.

Shape factor SF-2 means a value indicating the ratio of unevenness in the shape of a particle and represented by the value obtained by dividing the projection area (AREA) into a square of the peripheral length (PERI) of the projected image formed by projection of a particle onto a 2-dimensional plane and then multiplying the quotient and 100π/4 together. Namely, a shape factor SF-2 is defined by Equation (II):

[Equation 2]

$$SF\text{-}2=\{(PERI)^2/\text{AREA}\}\times(100/4\pi) \quad \text{(II)}$$

The greater a value of SF-2 is, the more marked the unevenness in the surface of a particle.

If a value of SF-2 is too great in this invention, the unevenness in the surface of a toner particle decreases the transferring effect, thereby causing the transfer whitening clear.

In the present invention, 100 toner particles are sampled at random and their image information item obtained by using a scanning electron microscope FE-SEM (S-800) available from Hitachi, Ltd. is introduced via an interface into an image forming apparatus (Luzex 3) available from Nireco, Ltd. and analyzed, then the values obtained by the computation in accordance with the above equations are defined as SF-1 and SF-2.

As toner used for the present invention, the weight average particle diameter ranges better from 5 to 10 μm, preferably from 6 to 10 μm and well preferably from 6 to 8 μm. If the weight average particle diameter is excessively smaller than 5 μm, toner becomes likely to slip off from a cleaning blade, whereas toner loses in fluidity and becomes likely to affect the developing property if excessively greater than 10 μm. Thus, both extremes are not preferable.

In the present invention, the weight average particle diameter of toner is measured by the following method.

The particle diameter distribution of toner in the present invention can be measured by using Coulter Counter TA-II Model or Coulter Multisizer (available from Calltar Co.). The electrolyte is prepared by using primary sodium chloride to make an aqueous solution of 1% NaCl. For example, ISOTONR-II (available from Coulter Scientific Japan Co.) can be used.

The measuring method proceeds as follows: To 100 to 150 ml of the above electrolyte, 0.1 to 5 ml of a surfactant, preferably alkyl benzene sulfonate is added as dispersant and further 2 to 20 mg of the measuring sample is added. The electrolyte with the sample suspended is subjected to the dispersion treatment for approx. 1 to 3 min by using an ultrasonic disperser, then the volume of toner not smaller in particle diameter than 2 μm and number of particles are measured by using a 100 μm aperture as the aperture to compute the volume distribution and the particle number distribution. Therefrom. the weight average particle diameter ($D_4$) according to the weight standard (the representative value of each channel is regarded as the representative value for each channel) found from the volume distribution in the present invention can be evaluated.

As channels, for example, 13 channels comprising a range from 2.00 (inclusive) to 2.52 μm, a range from 2.52 (inclusive) to 3.17 μm, a range from 3.17 (inclusive) to 4.00 μm, a range from 4.00 (inclusive) to 5.04 μm, a range from 5.04 (inclusive) to 6.35 μm, a range from 6.35 (inclusive) to 8.00 μm, a range from 8.00 (inclusive) to 10.08 μm, a range from 10.08 (inclusive) to 12.70 μm, a range from 12.70 (inclusive) to 16.00 μm, a range from 16.00 (inclusive) to 20.20 μm, a range from 20.20 (inclusive) to 25.40 μm, a range from 25.40 (inclusive) to 32.00 μm, and a range from 32.00 (inclusive) to 40.30 μm.

The true specific gravity of toner ranges preferably from 0.3 to 2.5 g/cm$^3$ and well preferably from 0.5 to 2.0 g/cm$^3$, while the triboelectrically charged amount per weight of toner ranges preferably from 5 to 50 mC/kg and well preferably from 10 to 40 mC/kg.

If the true specific gravity of the toner is lower than 0.3 g/cm$^3$, the toner is brittle and easily destroyed. If the true specific gravity of the toner is higher than 2.5 g/cm$^3$, considerable amount of energy is required to eject the toner and therefore developing capability of the toner is reduced.

If the triboelectrically charged amount per weight of toner is smaller than 5 mC/kg, toner scatters and the development cannot be well carried out. If the triboelectrically charged amount per weight of toner is greater than 50 mC/kg, a phenomenon of charge-up occurs and the image density lowers.

In the present invention, the true specific gravity of toner is measured by the following method.

The true specific gravity of toner is measured in accordance JIS K 7112 B method (measurement by the picnometer method).

In the present invention, the triboelectrically charged amount per weight of toner is measured by the following method.

Figure 4:
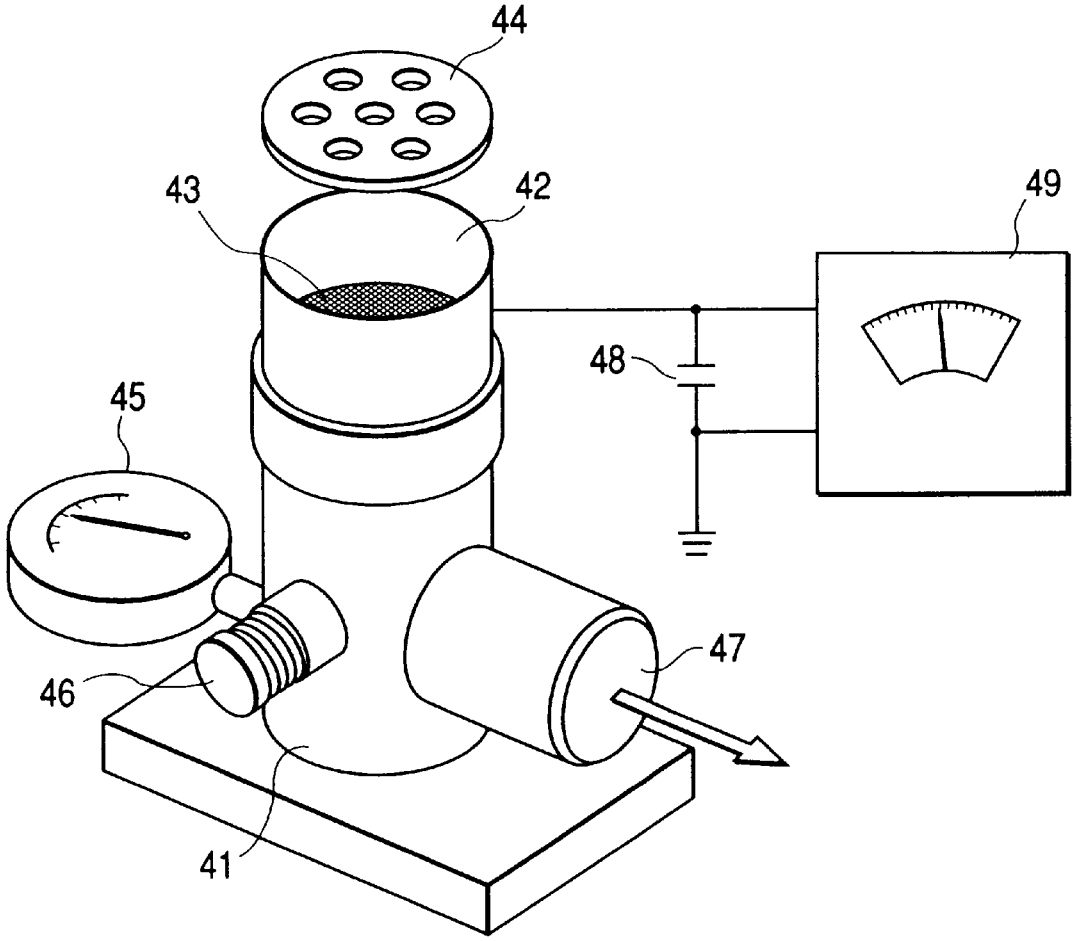
FIG. 4 is a schematic view of a charged amount measuring device for measuring the average charged amount per weight of toner.

Measurement is carried out using the charged amount measuring device shown in FIG. 4. Under environments comprising a temperature of 23° C. and a humidity of 60% Rh, spherical iron powder carrier of 100 mesh pass—200 mesh on (for example, spherical iron powder DSP 138 available from Dowa Iron Powder Co. is used) is used as the carrier and a mixture made by adding 0.5 g of toner to 9.5 g of carrier is put into a 50 to 100 ml volume polyethylene vessel and shaken 50 times by hand.

Next, 1.0 to 1.2 g of this mixture is put into a metallic measuring vessel 42 with a 500 mesh screen 3 provided at the bottom and a metallic lid 44 is put on the vessel. The whole measuring vessel 42 of this time is weighed to be $W_1$(g). Then, suction is performed through the suction port 47 by using a suction unit 41 (contact portion with the measuring vessel 2 is made at least of an insulator) and the ventilating amount adjusting valve 6 is adjusted to set the pressure of a vacuum gauge 45 to 250 mmAq.

At this state, suction is continued for 1 min to suck away and remove the toner. V (volt) is let to be the potential of a potentiometer 49 at this time. Here, Reference Numeral 48 denotes a capacitor, whose capacitance is designated with C (μF). Besides, the whole measuring vessel after the suction is weighed to be $W_2$ (g). The triboelectrically charged amount per weight of toner Qd (mC/kg) is calculated as follows.

$$Qd = \frac{CV}{W_1 - W_2}$$

If an image forming apparatus according to the present invention is an apparatus or forming a color image, color toner is used.

The color toner for the present invention is specifically a nonmagnetic toner comprising nearly spherical toner particles containing a charge-controlling agent and a low softening substance such as wax in addition to a binder resin and a colorant.

As binder resins, those used normally for color toner are available and for example, styrene copolymers such as styrene-acrylate copolymer and a styrene-methacrylate copolymer; polyester resins; and epoxy resins are enumerated.

As colorants, those used normally for color toner are available and for example, benzine yellow pigments, phoron yellow, anilide acetoacetate insoluble azo pigments, monoazo dyes and azo-methyne coloring matters are enumerated as colorants for yellow toner. As colorants for magenta toner, for example, xanthene dyes, phosphor tungsten molybdate lake pigments, 2,9-dimethylquinacrydone, naphthol insoluble azo pigments, anthraquinone dyes, color materials comprising xanthene dyes and organic carboxylic acids, thioindigo and naphthol insoluble azo pigments are enumerated. As colorants for cyan toner, for example, copper phthalocyanine pigments are referred. As colorants for black toner, for example, carbon black is referred.

As charge-controlling agents, those used normally for color toner are available and as negative charge controlling agents, for example, metallic complexes of alkyl salicylate, metallic complexes of dicarboxylic acids and polycyclic metallic salicylate salts are enumerated. As positive charge controlling agents, quaternary ammonium salts, benzothiazole derivatives, guanamine derivatives, dibutyl tin oxides and other nitrogen-contained compound are enumerated.

As low softening substances, paraffine wax, polyolefin wax, microcrystalline wax, Fischer Tropish wax, amide wax, higher fatty acids, long chain alcohols, ester wax and their derivatives such as graft compounds and block compounds are enumerated. The content of low softening point substances ranges preferably from 0.5 to 30% by weight and well preferably from 5 to 30% by weight relative to toner because the low temperature fixing property and the anti-offset performance can be fully improved.

The toner comprising nearly spherical toner particles used in the present invention is preferably polymerized toner obtained by the polymerization method for manufacturing toner particles by polymerizing a polymerizable monomer composition including a polymerizable monomer, a colorant, a charge controlling agent and a low softening point substance and well preferably polymerized toner obtained by polymerizing a polymerizable monomer composition in a solvent because the shape can be made into a spherical one. Control of the spherical degree and the particle diameter of toner particles can be achieved by appropriately controlling the manufacturing conditions in manufacturing toner particles by the polymerization method.

For toner according to the present invention, it is preferable to externally add trunk oxide particles such as silicon oxide pulverized powder, titanium oxide pulverized powder or alumina pulverized powder to toner particles as fluidity improver and these types of inorganic oxide pulverized powder are preferably those after the hydrophobic treatment.

The color toner used in the present invention may be singly used as one-component developer or else may be mixed with magnetic carrier particles and used as two-component developer. In either case, nonmagnetic toner comprising the above spherical toner particles is used as the used color toner. In the case of a two-component developer, for example, magnetic carrier particles can be used.

As magnetic carrier particles, a ferrite carrier, a resin coat ferrite carrier and a magnetic substance dispersion type resin carrier with an average particle diameter of 30 to 60 $\mu$m and further with a specific resistance of $1.0\times10^{6}$ to $1.0\times10^{13}$ $\Omega\cdot$cm are enumerated. Besides, as magnetic carriers, the T/D ratio ranges preferably from 4 to 10% by weight. Here, T denotes toner and D denotes the whole developer including toner particles, a carrier and an external additive.

In the present invention, the average particle diameter of a carrier is measured by the following method.

The average particle diameter of a magnetic carrier is measured using a combination of a laser diffraction type particle diameter distribution measuring device HELOS (available from Nippon Denshi) and a dry type dispersion unit RODOS (available from Nippon Denshi) in a particle diameter range of 0.5 $\mu$m to 350.0 $\mu$m divided into 31 channels as shown in Table 1 under measuring conditions comprising a lens focal distance of 200 mm, a dispersion pressure of 3.0 bar and a measuring time of 1 to 2 sec. and the 50% particle diameter (median diameter) of the volume distribution is evaluated as the average particle diameter.

TABLE 1

| Particle diameter Range ($\mu$m) | Particle diameter Range ($\mu$m) | Particle diameter Range ($\mu$m) | Particle diameter Range ($\mu$m) |
|---|---|---|---|
| 0.5 (inclusive) to 1.8 | 6.2 (inclusive) to 7.4 | 25.5 (inclusive) to 30.0 | 102.0 (inclusive) to 122.0 |
| 1.8 (inclusive) to 2.2 | 7.4 (inclusive) to 8.6 | 30.0 (inclusive) to 36.0 | 122.0 (inclusive) to 146.0 |
| 2.2 (inclusive) to 2.6 | 8.6 (inclusive) to 10.0 | 36.0 (inclusive) to 42.0 | 146.0 (inclusive) to 174.0 |
| 2.6 (inclusive) to 3.0 | 10.0 (inclusive) to 12.0 | 42.0 (inclusive) to 50.0 | 174.0 (inclusive) to 206.0 |
| 3.0 (inclusive) to 3.6 | 12.0 (inclusive) to 15.0 | 50.0 (inclusive) to 60.0 | 206.0 (inclusive) to 246.0 |
| 3.6 (inclusive) to 4.4 | 15.0 (inclusive) to 18.0 | 60.0 (inclusive) to 72.0 | 246.0 (inclusive) to 294.0 |
| 4.4 (inclusive) to 5.2 | 18.0 (inclusive) to 21.0 | 72.0 (inclusive) to 86.0 | 294.0 (inclusive) to 350.0 |
| 5.2 (inclusive) to 6.2 | 21.0 (inclusive) to 25.0 | 86.0 (inclusive) to 102.0 | |

<2> Image Forming Apparatus according to Present Invention

An image forming apparatus according to the present invention comprises: an image bearing member; a charging device; electrostatic latent image forming means; developing means; a transfer material carrying member; transfer means; and cleaning means; in which the above cleaning means uses the counter blade system having a cleaning blade in butt contact with the surface of the above image bearing member in a counter direction.

The butting pressure of a cleaning blade to be brought into butt contact with the surface of the above image bearing member is a line pressure N (g/cm) of $20<N<60$ and preferably $25\leqq N\leqq 55$. If the line pressure N is equal to or smaller than 20 g/cm, the toner remaining on the image bearing member cannot be fully cleaned, toner becomes likely to slip off and further fusion or filming becomes likely to occur on the surface of the image bearing member. If the line pressure N is equal to or greater than 60 g/cm, the toner remaining on the image bearing member increases in cleanness, but an increase in the surface wear of the outermost layer of the image bearing member causes a decrease in the service life of the image bearing member.

In the present invention, the line pressure N of a butting pressure of the cleaning blade against the image bearing member means the total pressure of the cleaning blade per length against the cleaning blade. In measuring the total pressure, a cleaning blade is pushed to the surface of the image bearing member with a load converter mounted on the pseudo image bearing member and the resultant load can be measured as the total pressure.

In the present invention, the surface of the outermost layer of the above image bearing member is worn by the above cleaning edge, the scraped dust generated thus is accumulated at the edge of the cleaning blade and not only the scraped dust derived from the surface of the outermost layer of the above image bearing member but part of the residual toner component also are accumulated at the edge of this cleaning blade. The cohesive degree $\alpha$ (%) of particles containing the scraped dust from the surface of the outermost layer of the above image bearing member, accumulated at the edge of this cleaning blade, is well in a range of $10 \leqq \alpha \leqq 60$ and preferably in a range of $12 \leqq \alpha \leqq 58$. With increasing value of this cohesive degree, the fluidity of particles worsens.

In a system that the cohesive degree $\alpha$ (%) of particles containing the scraped dust, specified in the present invention exceeds 60%, the edge of a cleaning blade is considerably instabilized and toner from the blade edge becomes likely to slip off when using nearly spherical toner as described in the present invention. In a system that the cohesive degree $\alpha$ (%) of particles containing the scraped dust is smaller than 10%, which means an excessive less degree of wear in the image bearing member, fusion or filming becomes likely to occur on the surface of the image bearing member.

In the present invention, the cohesive degree $\alpha$ (%) of particles containing the scraped dust generated from the wear by the above cleaning blade is a value computed by using Equation (III) to (VI) after measuring the weight of the scraped dust on each sieve.

[Equation 3]

$$\alpha^1 = \frac{\text{sample weight on 60 mesh sieve}}{5.0} \times 100 \quad \text{(III)}$$

[Equation 4]

$$\alpha^2 = \frac{\text{sample weight on 100 mesh sieve}}{5.0} \times 100 \times 3/5 \quad \text{(IV)}$$

[Equation 5]

$$\alpha^3 = \frac{\text{sample weight on 200 mesh sieve}}{5.0} \times 100 \times 1/5 \quad \text{(V)}$$

[Equation 6]

$$\alpha = \alpha^1 + \alpha^2 + \alpha^3 \quad \text{(VI)}$$

As the measuring device, a powder tester (available from Hosokawa Micron Co.) equipped with a digital vibrometer (Digivibro Model 1332) is used.

As the measuring method, sieves of 200 mesh, 100 mesh and 60 mesh are stacked and set on a vibration stand in the narrowing sequence, i.e. in the sieve sequence of 200 mesh, 100 mesh and 60 mesh so as to place the 60 mesh sieve on the top.

Onto this setup 60 mesh sieve, 5 g of accurately weighed sample is added and a vibration is applied thereto for approx. 15 sec. with an input voltage to the vibration stand set to 21.7V, the width of displacements in the digital vibrometer set to 0.130 while the amplitude of the vibration stand is adjusted as to fall within a range of 60 to 90 $\mu$m (the rheostat scale: approx. 2.5). Thereafter, the weight of the sample remaining on each sieve is measured and the cohesive degree is computed in accordance with the above equations.

Samples allowed to stand for approx. 12 hr under environments comprising a temperature of 23° C. and a humidity of 60% Rh are used and the measuring environments comprises a temperature of 23° C. and a humidity of 60% Rh.

As performed in the example mentioned later, particles containing scraped dust serving as samples used for measurements of the cohesive degree comprise those adhered to the edge of a cleaning edge out of the powder accumulated at the edge of the cleaning blade after the formation of 1000 continuous images under environments comprising an image coverage factor of 10%, a temperature of 25° C. and a humidity of 60% Rh and those obtained by collecting the powder remaining in the nip traces left on a photosensitive drum, As the cleaning blade, a highly hard, elastic, wear-resistant, oil-resistant and ozone-resistant rubber material is preferable. Specifically, the hardness ranges from 50 to 80° (Hs) and preferably from 65 to 77°, the impact resilience ranges from 10 to 50% and preferably from 30 to 40%, the plate thickness ranges from 0.5 to 4.0 mm and preferably from 1.0 to 3.0 mm, the butting angle against the image bearing member of a cleaning blade ranges from 20 to 35° and preferably from 25 to 30° and the free length ranges from 2 to 12 mm and preferably from 5 to 10 mm. These may be appropriately adjusted within limits that the butting pressure is as mentioned above and the line pressure N falls in a range of $20<N<60$ (g/cm).

In the present invention, the hardness (Hs) of a cleaning blade is based on JIS K 6253, the impact resilience is based on JIS K 6255 and the free length of the cleaning blade means the length of a not fixed and free portion of the cleaning blade.

As a cleaning blade as mentioned above, there is no special limitation, but urethane rubber is referred preferably.

Figure 2:
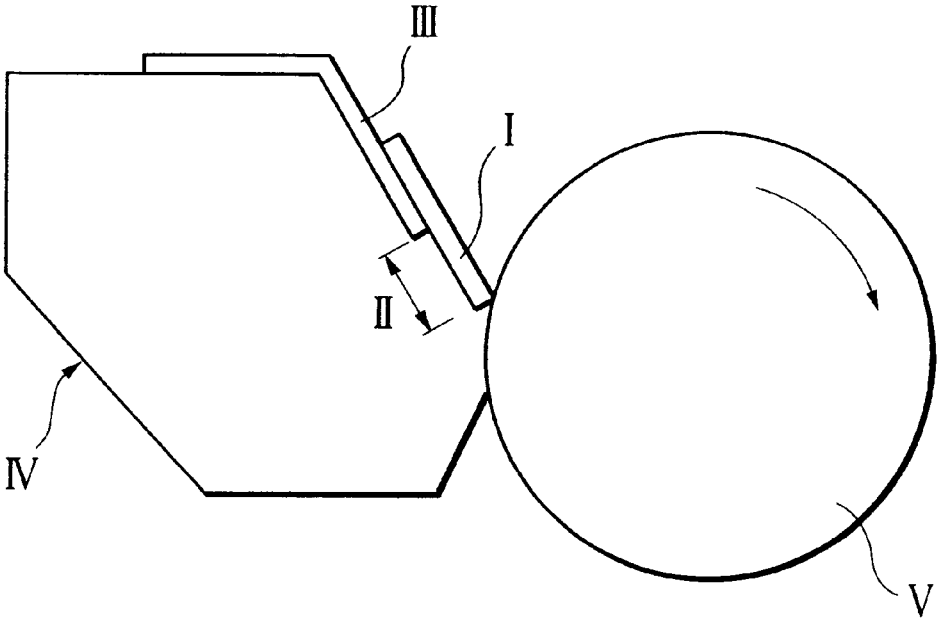
FIG. 2 is a schematic view of cleaning means in an image forming apparatus according to one embodiment of the present invention.

One embodiment of cleaning means used in an image forming apparatus according to the present invention will be described referring to FIG. 2, but the present invention is not limited to the present invention.

As cleaning means, a cleaning device IV comprising a cleaning blade I and a rear plate II is referred. The urethane-based cleaning blade I is an urethane-based elastic blade having a hardness of 77° (Hs), an impact resilience of 41% (impact resilience at 40° C.: 63%) and a 300% modulus of 200 kg/cm$^2$ (any of them in accordance with JIS standard) and the plate thickness is 2 mm. With a butting angle of 24° against the image bearing member V and a butting pressure of 33 g/cm, it is disposed.

As a rear plate III, a 1 mm thick 20 c SUS is disposed.

The free length II of the cleaning blade I is 10 mm. The transfer residual toner on the surface of the image bearing member V scraped by the cleaning blade I is collected in the waste toner vessel of a cleaning device.

The present invention is characterized by specifying the tolerance of the cohesive degree of the scraped dust as to prevent the occurrence of these problems. Keeping the cohesive degree $\alpha$ of the scraped dust within the above range can be achieved by using an image bearing member made of a resin composition with the line pressure N on the image bearing member of a cleaning blade set to the above range of $20<N<60$ (g/cm) and further at least fluorine resin particles added to the outermost layer of the image bearing member in a content F (%) of preferably $10 \leqq F < 50$ and well preferably $20 \leqq F < 40$ to control the moving rate of the image bearing member and/or by selecting a rubber material for the cleaning blade.

Especially, to keep the cohesive degree $\alpha$ of the scraped dust within the above range, a rubber material for the above cleaning blade is selected with the hardness of the blade not lower than 50° (Hs) and preferable higher than 65°. If the hardness is low, $\mu$ (slidability) between a photosensitive drum and the blade worsens at the rotational drive of the photosensitive drum as the image bearing member, so that plenty of scraped dust is generated at the initial period (time of rotational drive start) and the cohesive degree $\alpha$ also rises.

For an image bearing member according to the present invention, there is no special limitation, but an image bearing member is preferable which contains fluorine resin particles in the outermost layer so as to set their content F (% by weight) to a range of $10 \leqq F < 50$ and preferably a range of $20 \leqq F \leqq 30$ because the cohesive degree $\alpha$ of scraped dust by the wear of the outermost layer in the image bearing member is easily controllable within the limits of the present invention.

If an excessively large number of the fluorine resin particles are contained in the outermost layer, a latent image is formed only shallowly, so that at a short pause of AC voltage, the AC voltage is stopped for low tribo toner and a latent image cannot be transferred for a period till the application of a pull-back voltage. Thus, the unevenness in the tribo of toner tends to be directly reflected to that of dots, thereby resulting in formation of an uneven image. However, it has been also found that an exceedingly reduced content worsens the slidability between the outermost layer and a cleaning blade and amplifies the amount of scraped dust by the wear of the outermost layer of the image bearing member and the aggregation of the scraped dust tends to make it easy for toner slip-off to occur.

As the image carrying member, a photosensitive member having a photosensitive layer provided on the conductive support and further having the above outermost layer is preferably referred.

As the conductive support of a photosensitive member, a metal such as iron, copper, nickel, aluminum, titanium, tin, antimony, indium, lead, zinc, gold or silver, their alloys, their oxides, carbon, a conductive resin or the like can be used. With respect to the shape, a cylindrical, belt-shaped or sheet-shaped one is employed.

As photosensitive layers of a photosensitive member, an subbing layer, a charge generating layer, a charge transport layer, a mold release layer and like are enumerated and as the binder resin used for them, a normally available resin is used without special limitation.

As a charge generating material used for the charge generating layer, a normally available resin can be used. Besides, as a charge transport material for the charge transport layer, polyimide, polycarbonate and polybisphenol are referred.

As the outermost layer of a photosensitive member, a mold release layer is used.

As fluorine resin particles used for the outermost layer, a fluorine-contained polymer such as tetrafluoroethylene, hexafluoropropylene, trifluoroethylene, chlorotrifluoroethylene, vinylidene fluoride, vinyl fluoride or perfluoroalkylvinyl ether; and their copolymer are referred.

Fluorine resin particles are dispersed into a binder resin used normally to configure the outermost layer of a photosensitive member and used. Dispersion of fluorine resin particles into the binder resin constituting the outermost layer of a photosensitive member is carried out, for example, using a mixing/dispersing unit such as a sand mill, a ball mill, a roll mill, a homogenizer, a nanomizer, a paint shaker or an ultrasonic device. Besides, in dispersion, a fluorine surfactant, a graft polymer and a coupling agent may be supplementally used.

The surface roughness Rz of the outermost layer of a photosensitive member is preferably less than 5.0 $\mu$m in the axial direction, well preferably 0.1 to less than 5.0 $\mu$m and still well preferably 0.1 to 0.3 $\mu$m. If the surface roughness is excessively greater than 5 $\mu$m, gaps appear between the butt surfaces of the blade and the drum, through which toner slips off, and therefore this greatness is unfavorable.

That the surface roughness Rz is less than 5.0 $\mu$m in the axial direction means that the value of Rz obtained when measuring the surface roughness in the axial direction of a photosensitive member is less than 5.0 $\mu$m.

In the present invention, the surface roughness Rz corresponds to the center line average roughness measured using a surface roughness measuring instrument (surf coder SE-30H; available from Kosaka Lab. Co.) in accordance with JIS surface roughness "JIS B 0601". Specifically, as measured length Rz, a portion of 2.5 mm is sampled and the value evaluated in accordance with Equation (VII) when taking X axis as the center line of this sampled portion and Y axis as the direction of the vertical magnification and representing the roughness curve by y=f (x) is expressed in $\mu$m and called surface roughness.

[Equation 7]

$$R_z = 1/a \int_0^a |f(x)| dx \qquad \text{(VII)}$$

Setting the surface roughness (Rz) of a photosensitive member in the present invention to the above range becomes performable, for example, by changing the polishing state of the outermost layer of the photosensitive member. That is, if polishing of the surface is made roughly the surface roughness can be made larger, and if polishing of the surface is made finely, the surface roughness can be made smaller.

To the above image bearing member and means other than cleaning means such as, e.g. charging device, electrostatic latent image forming means, developing means, transfer material carrying member and transferring means among means used for an image forming apparatus according to the present invention, similar means used in a normal image forming apparatus are applicable.

An image forming apparatus according to the present invention is allowable to be a color image forming apparatus in which image forming parts each comprising the above image bearing member and the above transferring means are provided for each color of first to four colors of toner and the above transferring means is transferring means with individual colors of toner images overlapped in sequence onto a transfer material carried and conveyed by the above transfer material carrying member.

The image forming part preferably comprises the above image bearing member, transferring means, charging means, electrostatic latent image forming means, developing means and cleaning means. As transferring means in such an image forming part, the 4-tandem system of forming each color electrostatic latent image of first to four colors of toner on an image bearing member, creating toner images and transferring them onto a transferring material in sequence is specifically referred.

Figure 1:
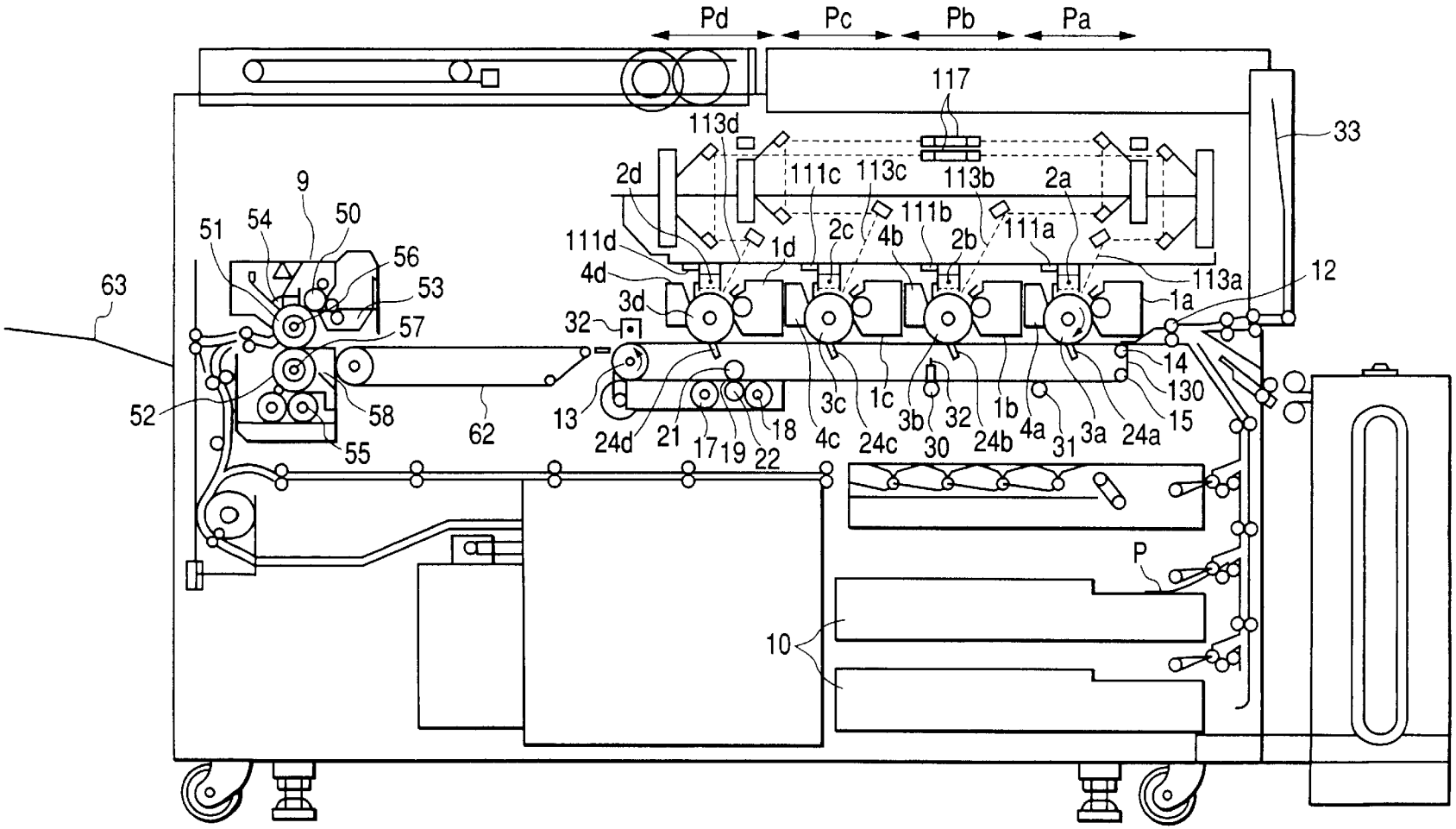
FIG. 1 is a schematic view of an image forming apparatus according to one embodiment of the present invention.

Next, referring to FIG. 1, a schematic configuration of one embodiment of color electrography forming apparatus will be described in details, but the present invention is not limited to this. An image forming apparatus according to the present invention will be described using a color electrophotography image forming apparatus equipped with multiple image bearing members and multiple image forming parts. FIG. 1 is a sectional illustration showing the general configuration of an image forming apparatus.

Inside the main body of an image forming apparatus, process means built-in image forming parts Pa, Pb, Pc and Pd are disposed in a horizontal direction, under each of which an endless-shaped transfer belt 130 as the transfer material carrying member is placed over belt driving rollers 13, 14 and 15. The above transfer belt 130 is rotated by rotation in the arrowhead direction of a belt driving roller 13 in use of an unillustrated driving motor. A cassette 10 accommodates a recording sheet P as the transfer material and the recording sheet P accommodated in the above cassette 10 is delivered from the top side. And, not only the skew delivery is adjusted but synchronization with the above image forming parts Pa, Pb, Pc and Pd is also achieved by a pair of registration rollers 7 in the conveyance over the transfer belt 130. A conveying guide 12 guides the above recording sheet P from the registration roller pair to the transfer belt 130.

Next, the configuration of the above image forming parts Pa, Pb, Pc and Pd will be described. They have photosensitive drums 3*a*, 3*b*, 3*c* and 3*d* as image bearing members, around which primary chargers 2*a*, 2*b*, 2*c* and 2*d* as charging means constituting process means, developing instruments 1*a*, 1*b*, 1*c* and 1*d* as developing means, the transfer chargers 24*a*, 24*b*, 24*c* and 24*d* as transferring means, cleaning units 4*a*, 4*b*, 4*c* and 4*d* as cleaning means and pre-exposure light sources 113*a*, 113*b*, 113*c* and 113*d* as electrostatic latent image forming means are respectively provided. Besides, above the above photosensitive drums 3*a*, 3*b*, 3*c* and 3*d*, a laser beam scanner is provided.

Prior to the exposure of photosensitive drums 3*a*, 3*b*, 3*c* and 3*d*, the above primary chargers 2*a*, 2*b*, 2*c* and 2*d* uniformly charge the respective drum surfaces and the developing instruments 1*a*, 1*b*, 1*c* and 1*d* adhere individual color toner of black, magenta, yellow and cyan to latent images formed on the respective drum surfaces at the exposure and visualize them to make toner images. Besides, the transfer chargers 24*a*, 24*b*, 24*c* and 24*d* transfer the toner images formed on the photosensitive drums 3*a*, 3*b*, 3*c* and 3*d* to the recording sheet P and the cleaning units 4*a*, 4*b*, 4*c* and 4*d* remove the transfer residual toner adhered to the respective photosensitive drums after the image transfer. The pre-exposure light sources 113*a*, 113*b*, 113*c* and 113*d* eliminate the respective surface potentials of the photosensitive drums 3*a*, 3*b*, 3*c* and 3*d* and the laser beam scanner, comprising a semiconductor laser, a polygon mirror, a fθ lens and the like, receives an input of an electric digital image signal and irradiates a laser beam modulated corresponding to the signal in the generator directions of the respective photosensitive drums 3*a*, 3*b*, 3*c* and 3*d* to accomplish the exposure.

A separate charger 32 serves to separate recording sheets P conveyed on the transfer belt 130. A fixing instrument 9 is fixation means for fixing the transfer image transferred to a recording sheet P and comprises a fixing roller 51 with heating means such as a heater provided inside and a pressing roller 52. An exhaust tray 63 serves to load recording sheets P exhausted outside the apparatus.

Next, the image forming operation will be described. When an image forming operation start signal is inputted into the apparatus body 1, the photosensitive drum 3*a* begins to rotate in the arrowhead direction and is uniformly charged by the primary charger 2*a*, while the laser beam modulated by the image signal corresponding to the black component of a draft image is irradiated to the drum surface by the laser beam scanner to form an electrostatic latent image (exposure). Then, black color toner is supplied by the developing instrument 1*a* to form a toner image visualized form the above latent image.

On the other hand, recording sheets P accommodated in the cassette 10 are delivered and conveyed onto the transfer belt 130 at the timing retained with the toner image formed on the above photosensitive drum 3*a* after the adjustment of a skew delivery by means of a temporary pause registration roller pair. The recording sheet P sent onto the above transfer belt 130 is transfer-charged by the transfer charging instrument 24*a* at the transfer section of the image forming part Pa and a toner image is transferred to the recording sheet P. The above steps are performed similarly also in the image forming parts Pa, Pb, Pc and Pd and a magenta color toner image, a yellow color image and a cyan color image are transferred in sequence to the recording sheet P.

The recording sheet P completed in image transfer is separated by the separate charger 32 at the left end part of the transfer belt 130 while subjected to the AC potential elimination and conveyed to the fixing instrument 9. And, the recording sheet P subjected to image fixing by the above fixing instrument 9 is exhausted to the exhaust tray 63 outside the apparatus.

As mentioned above, to well clean the high roundness toner whose cleaning has so far been hardly accomplished, a cleaning edge must be stably brought into butt contact with an image bearing member. By regulating the cohesive degree of scraped dust in the outermost layer of the relevant image bearing member, generated from the wear by the relevant cleaning blade, within a specified range to attain this purpose, the present invention can provide an image forming apparatus capable of performing a good cleaning with a stable butt contact of the relevant cleaning edge secured.

As a result, a great improvement in the reliability of an electrophotography device and provision of an image forming apparatus having respondent cleaning means even for an epoch-making leap of the productivity in the electrophotography device become possible.

EXAMPLES

Hereinafter, referring to examples, the present invention will be described specifically, but is not limited to these.

Example 1

This example used the color image forming apparatus shown in FIG. 1, similar to the above embodiment. A description is made referring to a color image forming apparatus equipped with multiple image forming parts, comprising multiple image bearing member. FIG. 1 is a sectional illustration showing the general configuration of an image forming apparatus and FIG. 2 is an illustration showing individual parts of a process unit.

The maximum image width of in an image forming apparatus according to the present invention is approx. 290 mm of A4 width and the peripheral speed of a photosensitive drum is 300 mm/sec.

As the photosensitive drum used in this example, a photosensitive drum a comprising a conductive substrate, a charge generating layer coated thereon, a charge transport layer further coated thereon and a mold release layer containing 30% by weight (relative to the weight of the mold release layer) of Teflon (polytetrafluoroethylene resin particles) as the outermost layer yet further coated thereon was used.

The photosensitive drum a used in this example was manufactured as follows.

To 170 parts by weight of n-butyl alcohol in which 4 parts by weight of polyvinyl butyral resin (Eslec BM-S; available from Sekisui Chemicals) was dissolved, 30 parts by weight of organic zirconium compound (acetylacetone zirconium butylate) and 3 parts by weight of organic silane compound (γ-aminopropyltrimethoxysilane) were added and the mixture was agitated to provide an apply liquid for the formation of a subbing layer. This apply liquid was applied onto a 30 mm diameter PED tube aluminum substrate roughened by the horning treatment and air-dried for 5 min. at room temperature, then the substrate was raised in temperature up to 50° C. in 10 min. and subjected to the humid accelerated hardening treatment for 20 min. in a thermo-hygrostat of 50° C. and 85% RH (dew point: 47° C.). Thereafter, drying was carried out at 170° C. for 10 min. in a hot-air drier. As the charge generating material, gallium chloride phthalocyanine was used and a mixture comprising 15 parts by weight thereof, 10 parts by weight of a vinyl chloride-vinyl acetate copolymer resin (VMCH; available from Nippon Unitica Co.) and 300 parts by weight of n-butyl alcohol was dispersed using a sand mill for 4 hr. The obtained dispersed solution was dip-coated on the above subbing layer and dried to form a 0.2 μm charge generating layer. Then, 4 parts by weight of N,N'-diphenyl-N,N'-bis-(3-methylphenyl)-[1,1'-biphenyl]-4,4'-diamine and 6 parts by weight of a bisphenol Z polycarbonate resin (molecular weight: 40,000) were added and dissolved into 80 parts by weight of chlorobenzene. The obtained solution was coated onto the above charge generating layer and dried to form a 20 μm thick charge transport layer. Incidentally, for the outermost layer, a solvent comprising 30% of polytetrafluoroethylene contained as fluorine resin particles in the solvent of the same prescription as that of the above charge transport layer was used and coated on the above charge transport layer to form a mold release layer. By mechanically polishing the surface roughness of the obtained photosensitive drum, a photosensitive drum a, 3.0 μm in surface roughness Rz, was obtained.

Next, referring to FIG. 2, a cleaning unit according to the present invention will be described. In a cleaning vessel of the cleaning unit IV, a cleaning blade I butting against the surface of the above photosensitive drum V is retained.

The cleaning blade I, composing an urethane-based elastic blade of 77° hardness (Hs), 41% impact resilience (impact resilience at 40° C.: 63%) and 200 kg/cm$^2$ in 300% modulus (any of them is based on JIS standard), is disposed at a butting angle of 24° and a butting pressure of 33 g/cm against the photosensitive member A. The cleaning blade 20*a* is 2 mm thick, in which SUS (1 mm thick) of a member 20*c* is provided as the rear plate III. The free length II of the cleaning blade is 10 mm.

As the pre-exposure 113 in FIG. 1, an LED (GaAlAs element) mainly with a peak wavelength of 660 nm is used, in which the half width defined by a half of the peak value is approx. 25 nm and the exposure value is 20 μJ/cm$^2$. The rate from the pre-exposure 113 to the unillustrated primary charger is approx. 50 mm/sec.

The fixing instrument 9 comprises a fixing roller 51, a pressing roller 52, heat resistant cleaning members 54 and 55 for cleaning both of them respectively, roller heating heaters 56 and 57 provided in the rollers 51 and 52, an apply roller 50 for applying a mold release agent oil such as dimethyl silicone oil to the fixing roller 51, an oil basin 53 of this oil and a thermistor 58 for sensing the surface temperature of the pressing roller 52 and controlling the fixing temperature. In the transferring material P with four color toner images transferred thereon, mixing and fixing of toner images to the transferring material P is accomplished and a full-color copy image is formed.

Meanwhile, as the two-component developer in the present invention, a mixture of a polymer toner prepared by the suspension polymerization method and a resin magnetic carrier prepared by the polymerization method was used. The color toner used in the present invention was manufactured specifically as follows.

(Manufacturing Example of Nonmagnetic Cyan Toner 1)

After th:rowing 450 parts by weight of 0.1 M—$Na_3PO_4$ aqueous solution into 710 parts by weight of ion-exchange water and heating the mixture up to 60° C., it was agitated eat 12,000 rpm by using a TK Homomixer (available from Tokshu Kika Kogyo). 68 parts by weight of 1.0M—$CaCl_2$ aqueous solution was gradually added to this to provide an aqueous medium.

| | |
|---|---|
| (mononer) styrene | 165 parts by weight |
| n-butyl acrylate | 35 parts by weight |
| (colorant) C.I. Pigment Blue 15:3 | 15 parts by weight |
| (charge controlling agent) metal salicylate compound | 3 parts by weight |
| (polar resin) saturated polyester(acidity: 14; peak molecular weight: 8,000) | 10 parts by weight |
| (mold releasing agent) ester wax (melting point: 70° C.) | 50 parts by weight |

On the other hand, the above formulation was heated to 60° C., it was uniformly dissolved and dispersed at 12,000 rpm by using a TK Homomixer (available from Tokshu Kika Kogyo). Into this, 10 parts by weight of polymerization initiator, 2,2'-azo bis(2,4-dimethylvaleronitril) was dissolved to prepare a polymerizable monomer composition.

Into the aqueous medium obtained above, the above polymerizable monomer composition was thrown and agitated for 10 min. at 10,000 rpm by using a TK Homomixer at 60° C. under an $N_2$ atmosphere to granulate a polymerizable monomer composition. Thereafter, the product was heated to 80° C. while agitated by using a paddle agitator vane and allowed to react for 10 hr. After the completion of a polymerizing reaction, the residual monomer was removed under reduced pressure, hydrochloric acid was added after the cooling and calcium phosphate was dissolved. Then, after the filtration, the water washing and the drying, toner particles were obtained.

The obtained non-magnetic polymer toner particles are nearly spherical toner particles with a shape factor SF-1 of 115 and a shape factor SF-2 of 110 whose surface was smooth. 100 parts by weight of the polymer toner particles obtained above and 2.2 parts by weight of silica pulverized powder subjected to the hydrophobic treatment were mixed to prepare a non-magnetic cyan toner 1 subjected to the external addition treatment. The obtained non-magnetic cyan toner 1 had a weight average particle diameter of 8.0 μm and a triboelectrically charged amount of 25 mC/kg per weight for the true specific gravity of 1.05 g/cm$^3$.

As magnetic carriers, a silicone resin coated ferrite carrier having a magnetization amount of 10000 kA/mm$^2$ (100 emu/cm$^3$) in a magnetic field of 79 KA/m (1 kilo oersted), the average particle diameter of 40 μm and a specific resistance of $1\times10^{13}$ Ω·cm was used.

The ratio of the T/D ratio (ratio of T (toner) to D (whole developer) in a developing instrument) was 8% by weight.

In the above image forming apparatus, the amount of the above non-magnetic toner 1 corresponding to a toner adhered amount of 0.5 mg/cm$^2$ on an image bearing member with 30% by weight of fluorine resin particles dispersed in the outermost layer was developed, image formation corresponding to 100 A4 sheets was performed in a system of no paper delivery and the spherical toner was cleaned by means of the cleaning blade. At this time, the line pressure of the cleaning blade against the photosensitive member was measured and the edge part of the relevant cleaning blade was observed.

The obtained result is shown in Table 1. Besides, Table 2 also shows the cohesive degree of particles containing the scraped dust accumulated at the edge of the cleaning blade for each line pressure.

TABLE 2

| Line pressure of cleaning blade (g/cm) | 20 | 25 | 30 | 40 | 50 | 55 | 60 |
|---|---|---|---|---|---|---|---|
| Estimate of edge part | Toner slip-off | good | good | good | good | good | chattering (abnormal vibration) |
| Cohesive degree α (%) | 8% | 12% | 21% | 50% | 56% | 58% | 70% |

It was found from the above result that in the above system, no initial good cleaning could be made for 20 g/cm and 60 g/cm of blade line pressure against a photosensitive member and accordingly the blade line pressure against the photosensitive member was required to be made greater than 20 g/cm and smaller than 60 g/cm. Especially, the blade line pressure against the photosensitive member permitting an initial good cleaning was judged to a range of 25 to 55 g/cm and the blade was set to a line pressure of 40 g/cm within the above range in the following examples. Besides, the cohesive degree of particles containing scraped dust accumulated at the edge of the cleaning blade for line pressures of 25 to 55 g/cm ranged from 12 to 58%.

Example 2

The photosensitive drum b used in this example was manufactured as follows.

Except that 20% by weight of polytetrafluoroethylene is contained in the mold release layer as fluorine resin particles, a photosensitive drum was produced as with the photosensitive drum a. By mechanically polishing the surface roughness of the obtained photosensitive drum, a photosensitive drum b with its surface roughness Rz of 3.0 μm was obtained.

In the image forming apparatus used in Example 1, the line pressure of a cleaning blade against a photosensitive member was set to 40 g/cm, the above photosensitive member b was used in place of the photosensitive drum a as an image bearing member, an actual snapshot test of 20,000 copies was made with continuous 100 sheets of image coverage factor 10% under environments comprising a normal temperature and a normal humidity and the image obtained at the 20,000th sheet was estimated visually. This result is shown in Table 3. As a result, the cohesive degree of particles containing scraped dust of the outermost layer in the relevant image bearing member generated from the wear by the relevant blade was 25% and the cleaning property was good.

Comparative Example 1

The photosensitive drum c used in this example was manufactured as follows.

Except that 10% by weight of polytetrafluorcethylene is contained in the mold release layer as fluorine resin particles, a photosensitive drum was produced as with the photosensitive drum a. By mechanically polishing the surface roughness of the obtained photosensitive drum, a photosensitive drum c with its surface roughness Rz of 1.0 μm was obtained.

Except that an photosensitive drum c was used in place of the photosensitive drum b as an image bearing member in the image forming apparatus used in Example 2, an actual snapshot test of 20,000 copies was made with continuous 100 sheets of image coverage factor 10% under environments comprising a normal temperature and a normal humidity as with Example 2 and the image obtained at the 20,000th sheet was estimated visually. This result is shown in Table 3. A small amount of fluorine resins leads to excessive wear of the image bearing member, particles containing the scraped dust generated thus are aggregate and the cohesive degree α reached 70%. And, as a result of instability in the cleaning edge, a poor cleaning occurred.

Example 3

The photosensitive drum d used in this example was manufactured as follows.

Except that; 10% by weight of polytetrafluoroethylene is dispersed in the mold release layer as fluorine resin particles, a photosensitive drum was produced as with the photosensitive drum a. By mechanically polishing the surface roughness of the obtained photosensitive drum, a photosensitive drum d with its surface roughness Rz of 4.0 μm was obtained.

Except that an photosensitive drum d was used in place of the photosensitive drum b as an image bearing member in the image forming apparatus used in Example 2, an actual snapshot test of 20,000 copies was made with continuous 100 sheets of image coverage factor 10% under environments comprising a normal temperature and a normal humidity as with Example 2 and the image obtained at the 20,000th sheet was estimated visually. This result is shown in Table 3. Although the amount of the fluorine resin particles was small, the wearing of the surface of the image bearing member was controlled by increasing the initial polishing amount of the image bearing member to Rz 4.0 μm. The cohesive degree of the particles including the scraped dust was 40%, which is within a permissible range, so that the slip-off of the toner did not occur.

Comparative Example 2

First, the photosensitive drum e used in this example was manufactured as follows.

Except that 10% by weight of polytetrafluoroethylene was contained in the mold release layer as fluorine resin particles, a photosensitive drum was produced as with the photosensitive drum a. By mechanically polishing the surface roughness of the obtained photosensitive drum, a photosensitive drum e with its surface roughness Rz of 5.0 μm was obtained.

Except that the photosensitive drum e was used in place of the photosensitive drum b as an image bearing member in the image forming apparatus used in Example 2, an actual snapshot test of 20,000 copies was made with continuous 100 sheets of image coverage factor 10% under environments comprising a normal temperature and a normal humidity as with Example 2 and the image obtained at the 20,000th sheet was estimated visually. This result is shown in Table 3. The cohesive degree of particles containing scraped dust was 7% and the surface was excessively scraped by the initial polishing and slip-off of toner occurred at the initial stage.

Example 4

First, the photosensitive drum f used in this example was manufactured as follows.

Except that 30% by weight of polyetetrafluorothylene is dispersed in the mold release layer as fluorine resin particles, a photosensitive drum was produced as with the photosensitive drum a. By mechanically polishing the surface roughness of the obtained photosensitive drum, a photosensitive drum f with its surface roughness Rz of 0.5 $\mu$m was obtained.

Except that an photosensitive drum f was used in place of the photosensitive drum b as an image bearing member in the image forming apparatus used in Example 2, an actual snapshot test of 20,000 copies was made with continuous 100 sheets of image coverage factor 10% under environments comprising a normal temperature and a normal humidity as with Example 2 and the image obtained at the 20,000th sheet was estimated visually. This result is shown in Table 3. The initial polishing amount was small and the surface of the image bearing member was subject to scraping, but the effect of an improvement in the slidability of fluorine resin particles suppressed the cohesive degree $\alpha$ to 40% and the image obtained was good.

Comparative Example 3

First, the photosensitive drum g used in this example was manufactured as follows.

Except that 50% by weight of polytetrafluoroethylene was dispersed in the mold release layer as fluorine resin particles, a photosensitive drum was produced as with the photosensitive drum a. By mechanically polishing the surface roughness of the obtained photosensitive drum, a photosensitive drum g with its surface roughness Rz of 0.5 $\mu$m was obtained.

Except that an photosensitive drum g was used in place of the photosensitive drum b as an image bearing member in the image forming apparatus used in Example 2, an actual snapshot test of 20,000 copies was made with continuous 100 sheets of image coverage factor 10% under environments comprising a normal temperature and a normal humidity as with Example 2 and the image obtained at the 20,000th sheet was estimated visually. This result is shown in Table 3. The cohesive degree of particles containing scraped dust was 5% and an excessive content of fluorine resin particles in the outermost layer led to a non-uniform image formed on the surface of the image bearing member.

Comparative Example 4

The photosensitive drum h used in this example was manufactured as follows.

Except that 30% by weight of polytetrafluoroethylene was dispersed in the mold release layer as fluorine resin particles, a photosensitive drum was produced as with the photosensitive drum a. By mechanically polishing the surface roughness of the obtained photosensitive drum, a photosensitive drum h with its surface roughness Rz of 4.0 $\mu$m was obtained.

Except that an photosensitive drum h was used in place of the photosensitive drum b as an image bearing member in the image forming apparatus used in Example 2, an actual snapshot test of 20,000 copies was made with continuous 100 sheets of image coverage factor 10% under environments comprising a normal temperature and a normal humidity as with Example 2 and the image obtained at the 20,000th sheet was estimated visually. This result is shown in Table 3. An excessive reduction in the friction between the above image bearing member and the above cleaning blade kept the outermost layer surface of the above image bearing member almost from being worn, so that only a slight amount of scraped dust was present and the cohesive degree of particles containing scraped dust was 7%. In this case, however, deposition occurred on the surface of the above photosensitive drum.

Comparative Example 5

First, the photosensitive drum i used in this example was manufactured as follows.

Except that 10% by weight of polytetrafluoroethylene is dispersed in the mold release layer as fluorine resin particles, a photosensitive drum was produced as with the photosensitive drum a. By mechanically polishing the surface roughness of the obtained photosensitive drum, a photosensitive drum i with its surface roughness Rz of 1.0 $\mu$m was obtained.

Except that an photosensitive drum i was used in place of the photosensitive drum b as an image bearing member in the image forming apparatus used in Example 2 and further the non-magnetic toner 2 mentioned later as low roundness indefinite-shaped toner was used, an actual snapshot test of 20,000 copies was made with continuous 100 sheets of image coverage factor 10% under environments comprising a normal temperature and a normal humidity as with Example 2 and the image obtained at the 20,000th sheet was estimated visually. This result is shown in Table 3. An excessive reduction in the friction between the above image bearing member and the above cleaning blade kept the outermost layer surface of the above image bearing member almost from being worn, so that only a slight amount of scraped dust was present and the cohesive degree of particles containing scraped dust was 70%. In low roundness indefinite-shaped toner, toner did not slip off through the blade edge and a good cleaning was accomplished even though the blade edge was instabilized due to the presence of scraped dust, but nevertheless, the transferring property is deteriorated and as a result, a faulty image appears.

(Manufacturing Example of Nonmagnetic Cyan Toner 2)

| | |
|---|---|
| styrene-n-butyl acrylate copolymer (Mw: 70,000; Mn: 20,000) | 200 parts by weight |
| (colorant) C.I. pigment blue 15: | 315 parts by weight |
| (polar resin) saturated polyester (acidity: 14; peak molecular weight: 8,000) | 10 parts by weight |
| (charge controlling agent) metal salicylate compound | 3 parts by weight |
| (mold releasing agent) ester wax | 10 parts by weight |

After the above composition was fully molten and kneaded using an extruder, the cooled product was mechanically granulated coarsely, coarse grains were collided with a collision plate by using a jet flow and pulverized and pulverized grains were classified by means of an air stream classifier using the Coanda Effect. Thus, indefinite-shaped toner with SF-1 of 152 and SF-2 of 145 was obtained.

100 parts by weight of the toner particles obtained above and 2.2 parts by weight of fine silica powder subjected to the hydrophobic treatment were mixed to prepare nonmagnetic cyan toner 2 subjected to the external addition treatment. The obtained nonmagnetic cyan toner 2 had a weight average particle diameter of 8.0 μm.

Comparative Example 6

Using a cleaning blade of 84 hardness, an actual snapshot test of 20,000 copies was made with continuous 100 sheets of image coverage factor 10% under environments comprising a normal temperature and a normal humidity as with Example 2 and the image obtained at the 20,000th sheet was estimated visually. This result is shown in Table 3. An excessively high hardness caused an excessive scraping of the surface layer in the photosensitive drum and the cohesive degree of particles containing the scraped dust was 65%. And, as a result of instability in the cleaning blade edge, a faulty cleaning occurred.

Comparative Example 7

Using a cleaning blade of 50 hardness, an actual snapshot test of 20,000 copies was made with continuous 100 sheets of image coverage factor 10% under environments comprising a normal temperature and a normal humidity as with Example 2 and the image obtained at the 20,000th sheet was estimated visually. This result is shown in Table 3. An excessively low hardness led to hardly any scraping of the surface layer in the photosensitive drum and the cohesive degree α of particles containing the scraped dust was 5%. Thus, deposition occurred on the surface of the photosensitive drum.

Comparative Example 8

Setting the line pressure of a cleaning blade to 70 g/cm, an actual snapshot test of 20,000 copies was made with continuous 100 sheets of image coverage factor 10% under environments comprising a normal temperature and a normal humidity as with Example 2 and the image obtained at the 20,000th sheet was estimated visually. This result is shown in Table 3. An excessively high cleaning blade pressure caused an excessive scraping of the surface layer in the photosensitive drum and the cohesive degree of particles containing the scraped dust was 75%. And, as a result of instability in the cleaning edge, a faulty cleaning occurred.

TABLE 3

| | Photosensitive drum | | | Toner | | | | | |
|---|---|---|---|---|---|---|---|---|---|
| Example & Comparative Example | Drum no. | Content of fluorine resin particles (wt %) | Surface roughness Rz (μm) | Toner no. | Weight average particle diameter (μm) | Shape factor SF-1 | Shape factor SF-2 | Cohesive degree α (%) | Image estimate after the completion of 20,000 copies |
| Example 2 | b | 20 | 3.0 | 1 | 8.0 | 115 | 110 | 25 | Normal cleaning |
| Comparative Example 1 | c | 10 | 1.0 | 1 | 8.0 | 115 | 110 | 70 | Occurrence of toner slip-off |
| Example 3 | d | 10 | 4.0 | 1 | 8.0 | 115 | 110 | 40 | Normal cleaning |
| Comparative Example 2 | e | 10 | 5.0 | 1 | 8.0 | 115 | 110 | 7 | Occurrence of toner slip-off |
| Example 4 | f | 30 | 0.5 | 1 | 8.0 | 115 | 110 | 40 | Normal cleaning |
| Comparative Example 3 | g | 50 | 0.5 | 1 | 8.0 | 115 | 110 | 5 | Faulty image |
| Comparative Example 4 | h | 30 | 4.0 | 1 | 8.0 | 115 | 110 | 7 | Occurrence of deposition on the surface of the photosensitive drum |
| Comparative Example 5 | i | 1 | 70 | 2 | 8.0 | 152 | 145 | 70 | Faulty image (whitening clear) |
| Comparative Example 6 | i | 30 | 0.5 | 1 | 8.0 | 115 | 110 | 65 | Occurrence of toner slip-off |
| Comparative Example 7 | k | 30 | 0.5 | 1 | 8.0 | 115 | 110 | 5 | Occurrence of deposition on the surface of the photosensitive drum |
| Comparative Example 8 | l | 30 | 0.5 | 1 | 8.0 | 115 | 110 | 75 | Occurrence of toner slip-off |

Example 5

Except that in place of the photosensitive drum b as an image bearing member in the image forming apparatus used in Example 2, the above photosensitive drum f with 30% by weight of fluorine resin particles dispersed into the outermost layer of the relevant image bearing member whose surface roughness Rz was 0.5 μm was used and further the peripheral speed of the photosensitive drum f was changed from 300 mm/sec to 100 mm/sec, an actual snapshot test of 20,000 copies was made with continuous 100 sheets of image coverage factor 10% under environments comprising a normal temperature and a normal humidity as with Example 2 and the image obtained at the 20,000th sheet was estimated visually. The cohesive degree α of scraped dust was suppressed to 35% and the image obtained was good even for high roundness toner.

What is claimed is:

1. An image forming apparatus comprising:

an image bearing member for bearing an electrostatic latent image;

a charging device for applying a voltage to the surface of said image bearing member to charge the surface thereof;

electrostatic latent image forming means for forming an electrostatic latent image on the surface of said image bearing member charged by said charging device;

developing means for adhering toner carried on a toner carrying member to the electrostatic latent image formed on the surface of the image bearing member to form a toner image;

a transfer material carrying member for carrying and conveying a transfer material to the surface of said image bearing member;

transferring means for electrostatically transferring the toner image formed on the surface of said image bearing member to a transfer material; and cleaning means for cleaning said image bearing member, wherein said toner comprises toner particles with a shape factor SF-1 of 100 to 140 and a shape factor SF-2 of 100 to 120, said cleaning means comprises a cleaning blade brought into butt contact with the surface of said image bearing member in a counter direction at a line pressure N higher than 20 g/cm and lower than 60 g/cm, and a cohesive degree $\alpha$ of powder ranges from 10% to 60%, the powder including scraped dust which is generated by wearing of an outermost layer surface of said image bearing member due to butt contact with said cleaning blade and accumulated at the edge of the cleaning blade.

2. The image forming apparatus according to claim 1, wherein the cohesive degree $\alpha$ of powder containing that scraped dust ranges from 12% to 58% which is generated from the wear of the outermost layer surface of said image bearing member due to butt contact with said cleaning blade and accumulated at the edge of the cleaning blade.

3. The image forming apparatus according to claim 1, wherein said toner particles have a shape factor SF-1 of 100 to 130 and a shape factor SF-2 of 100 to 115.

4. The image forming apparatus according to claim 1, wherein said toner has a weight average particle diameter of 5 to 10 $\mu$m.

5. The image forming apparatus according to claim 1, wherein said toner has a weight average particle diameter of 6 to 10 $\mu$m.

6. The image forming apparatus according to claim 1, wherein said toner has a true specific gravity of 0.3 to 2.5 g/cm$^3$.

7. The image forming apparatus according to claim 1, wherein said toner has a true specific gravity of 0.5 to 2.0 g/cm$^3$.

8. The image forming apparatus according to claim 1, wherein said toner has a triboelectrically charged amount per weight of 5 to 50 mC/kg.

9. The image forming apparatus according to claim 1, wherein said toner has a triboelectrically charged amount per weight of 10 to 40 mC/kg.

10. The image forming apparatus according to claim 1, wherein said cleaning blade is in butt contact with the surface of said image bearing member at a line pressure N of higher than 25 g/cm to less than 55 g/cm.

11. The image forming apparatus according to claim 1, wherein said cleaning blade has a hardness (Hs) of 50 to 80°.

12. The image forming apparatus according to claim 1, wherein said cleaning blade has a hardness (Hs) of 65 to 77°.

13. The image forming apparatus according to claim 1, wherein said cleaning blade has an impact resilience of 10 to 50%.

14. The image forming apparatus according to claim 1, wherein said cleaning blade has an impact resilience of 30 to 40%.

15. The image forming apparatus according to claim 1, wherein an outermost layer of said image bearing member has at least fluorine resin particles added to thereto and the content F of fluorine resin particles in said outermost layer ranges from 10% to less than 50%.

16. The image forming apparatus according to claim 1, wherein the surface roughness Rz of an outermost layer of said image bearing member is smaller than 5.0 $\mu$m in the axial direction.

17. The image forming apparatus according to claim 1, wherein the surface roughness Rz of an outermost layer of said image bearing member ranges from 0.1 $\mu$m to less than 5.0 $\mu$m in the axial direction.

18. The image forming apparatus according to claim 15, wherein said image bearing member is a photosensitive drum in use for the electrophotography with a photosensitive layer comprising an organic photoconductor.

19. The image forming apparatus according to claim 1, wherein said image forming apparatus has an image forming part comprising said image bearing member, charging means, electrostatic latent image forming means, developing means, transferring means and cleaning means for each color toner of first to fourth colors and said transferring means is a device for transferring a toner image of each color to the transfer material carried and conveyed by said transfer material carrying member in sequential overlap.

20. An image forming method comprising: a charging step of applying a voltage to the surface of an image bearing member to charge the surface thereof; electrostatic latent image forming step of forming an electrostatic latent image on the surface of a charged image bearing member; a developing step of adhering toner carried on a toner carrying member to the electrostatic latent image formed on the surface of said image bearing member to form a toner image; a transferring step of electrostatically transferring the toner image formed on the surface of said image bearing member to a transfer material; and a cleaning step of cleaning the surface of said image bearing member after the transferring step by means of cleaning means, wherein said toner comprises toner particles with a shape factor SF-1 of 100 to 140 and a shape factor SF-2 of 100 to 120, said cleaning means comprises a cleaning blade brought into butt contact with the surface of said image bearing member in a counter direction at a line pressure N higher than 20 g/cm and lower than 60 g/cm, in a counter direction and a cohesive degree $\alpha$ of powder ranges from 10% to 60%, the powder including scraped dust which is generated by wearing of an outermost layer surface of said image bearing member due to butt contact with said cleaning blade and accumulated at the edge of the cleaning blade.

21. The image forming method according to claim 20, wherein the cohesive degree $\alpha$ of powder containing that scraped dust ranges from 12% to 58% which is generated from the wear of the outermost layer surface of said image bearing member due to butt contact with said cleaning blade and accumulated at the edge of the cleaning blade.

22. The image forming method according to claim 20, wherein said toner particles have a shape factor SF-1 of 100 to 130 and a shape factor SF-2 of 100 to 115.

23. The image forming method according to claim 20, wherein said toner has a weight average particle diameter of 5 to 10 $\mu$m.

24. The image forming method according to claim 20, wherein said toner has a weight average particle diameter of 6 to 10 $\mu$m.

25. The image forming method according to claim 20, wherein said toner has a true specific gravity of 0.3 to 2.5 g/cm$^3$.

26. The image forming method according to claim 20, wherein said toner has a true specific gravity of 0.5 to 2.0 g/cm$^3$.

27. The image forming method according to claim 20, wherein said toner has a triboelectrically charged amount per weight of 5 to 50 mC/kg.

28. The image forming method according to claim 20, wherein said toner has a triboelectrically charged amount per weight of 10 to 40 mC/kg.

29. The image forming method according to claim 20, wherein said cleaning blade is in butt contact with the surface of said image bearing member at a line pressure N of higher than 25 g/cm to less than 55 g/cm.

30. The image forming method according to claim 20, wherein said cleaning blade has a hardness (Hs) of 50 to 80°.

31. The image forming method according to claim 20, wherein said cleaning blade has a hardness (Hs) of 65 to 77°.

32. The image forming method according to claim 20, wherein said cleaning blade has an impact resilience of 10 to 50%.

33. The image forming method according to claim 20, wherein said cleaning blade has an impact resilience of 30 to 40%.

34. The image forming method according to claim 20, wherein an outermost layer of said image bearing member has at least fluorine resin particles added to thereto and the content F of fluorine resin particles in said outermost layer ranges from 10% to less than 50%.

35. The image forming method according to claim 20, wherein the surface roughness Rz of an outermost layer of said image bearing member is smaller than 5.0 $\mu$m in the axial direction.

36. The image forming method according to claim 20, wherein the surface roughness Rz of an outermost layer of said image bearing member ranges from 0.1 $\mu$m to less than 5.0 $\mu$m in the axial direction.

37. The image forming method according to claim 34, wherein said image bearing member is a photosensitive drum in use for the electrophotography with a photosensitive layer comprising an organic photoconductor.

38. The image forming method according to claim 20, wherein said image forming apparatus has an image forming part comprising said image bearing member, charging means, electrostatic latent image forming means, developing means, transferring means and cleaning means for each color toner of first to fourth colors and said transferring means is a device for transferring a toner image of each color to the transfer material carried and conveyed by said transfer material carrying member in sequential overlap.

* * * * *